US009757294B1

(12) United States Patent
Lo

(10) Patent No.: US 9,757,294 B1
(45) Date of Patent: Sep. 12, 2017

(54) HOSPITAL BED

(71) Applicant: DK City Corporation, Taichung (TW)

(72) Inventor: Chiu Hsiang Lo, Taichung (TW)

(73) Assignee: DK CITY CORPORATION, Taichung (TW)

( * ) Notice: Subject to any disclaimer, the term of this patent is extended or adjusted under 35 U.S.C. 154(b) by 17 days.

(21) Appl. No.: 15/199,667

(22) Filed: Jun. 30, 2016

(51) Int. Cl.

| | |
|---|---|
| ***A61G 7/015*** | (2006.01) |
| ***A61G 7/018*** | (2006.01) |
| ***A61G 7/07*** | (2006.01) |
| ***A61G 7/075*** | (2006.01) |

(52) U.S. Cl.
CPC ..... *A61G 7/015* (2013.01); *A61G 7/018* (2013.01); *A61G 7/07* (2013.01); *A61G 7/0755* (2013.01)

(58) Field of Classification Search
CPC ..... A61G 7/015; A61G 7/018; A61G 7/07; A61G 7/0755; A61G 13/08; A47C 20/041; A47C 20/12; Y10T 403/32221; Y10T 403/32861; Y10T 403/3868; Y10T 403/32893; Y10T 403/32918; F16C 11/045
See application file for complete search history.

(56) References Cited

U.S. PATENT DOCUMENTS

| | | | | |
|---|---|---|---|---|
| 4,385,410 A * | 5/1983 | Elliott | A61G 7/002 | 5/616 |
| RE35,201 E * | 4/1996 | Krauska | A61G 7/015 | 5/613 |
| 2011/0094032 A1* | 4/2011 | Shih | A47C 20/041 | 5/614 |
| 2012/0159712 A1* | 6/2012 | Lee | A61G 7/015 | 5/613 |
| 2014/0189954 A1* | 7/2014 | Lee | A61G 7/005 | 5/618 |
| 2016/0120719 A1* | 5/2016 | Bellingroth | A61G 7/018 | 74/99 R |

* cited by examiner

*Primary Examiner* — Eric Kurilla

(57) ABSTRACT

A hospital bed includes a frame, a backrest unit, a driving unit, a leg support unit and a linkage unit. The frame includes posts supported on a floor. The backrest unit is pivotally connected to the frame. The leg support unit includes a portion pivotally connected to the frame and another portion pivotally connected to the backrest unit. The leg support unit is located opposite to the backrest unit on the frame. The driving unit includes a portion connected to the frame and another portion pivotally connected to the backrest unit. The linkage unit connects the leg support unit to the backrest unit.

5 Claims, 7 Drawing Sheets

HOSPITAL BED

BACKGROUND OF INVENTION

1. Field of Invention

The present invention relates to a hospital bed and, more particularly, to a hospital bed equipped with a reliable linkage unit for linking a backrest unit to a leg support unit.

2. Related Prior Art

A hospital bed may include a manual mechanism operable to lift a backrest unit and a leg support unit or put them in a horizontal position to make a patient feel comfortable while sitting or lying. The manual mechanism includes a crank connected to the backrest unit and another crank connected to the leg support unit. The patient has to operate the cranks when he or she is alone. The patient has to get out of the hospital bed to operate the cranks and then get in the hospital bed several times until he or she reaches a right angle for the backrest unit and another right angle for the leg support unit. Obviously, the manual operation is inconvenient for the patient. The manual operation is very difficult if not impossible for a very sick or seriously injured patient.

As disclosed in Taiwanese Patent Nos. 342674 and 382943, a hospital bed includes a backrest unit, a leg support unit, an electric mechanism for driving the backrest unit, and a cable for connecting the leg support unit to the back rest unit so that the leg support unit is moved together with the backrest unit. The operation of the electric mechanism is convenient. However, the cable suffers elastic fatigue after some time of use, thereby jeopardizing the movement of the foot support unit.

The present invention is therefore intended to obviate or at least alleviate the problems encountered in prior art.

SUMMARY OF INVENTION

It is the primary objective of the present invention to provide a robust hospital bed.

To achieve the foregoing objective, the hospital bed includes a frame, a backrest unit, a driving unit, a leg support unit and a linkage unit. The frame includes posts supported on a floor. The backrest unit is pivotally connected to the frame. The leg support unit includes a portion pivotally connected to the frame and another portion pivotally connected to the backrest unit. The leg support unit is located opposite to the backrest unit on the frame. The driving unit includes a motor and a telescopic element. The motor is connected to the frame. The telescopic element includes an end operatively connected to the motor and another end pivotally connected to the backrest unit so that the motor moves the backrest unit between a lifted position and a lowered position relative to the frame via the telescopic element. The linkage unit includes at least one lever and two linking rods. The lever includes a middle portion formed between two ends. The middle portion of the lever is pivotally connected to the frame. The first linking rod includes an end pivotally connected to the first end of the levers and another end pivotally connected to the backrest unit. The second linking rod includes an end pivotally connected to the second end of the levers and another end pivotally connected to the leg support unit. In the lifted position, the backrest unit is located at an angle relative to the frame by the telescopic element, and the leg support unit is located at another angle relative to the frame via the linkage unit. In the lowered position, the backrest unit is flush with the frame because of the telescopic element, and the leg support unit is flush with the frame because of the linkage unit.

Other objectives, advantages and features of the present invention will be apparent from the following description referring to the attached drawings.

BRIEF DESCRIPTION OF DRAWINGS

The present invention will be described via detailed illustration of two embodiments referring to the drawings wherein.

DESCRIPTION OF EMBODIMENTS

Figure 1:
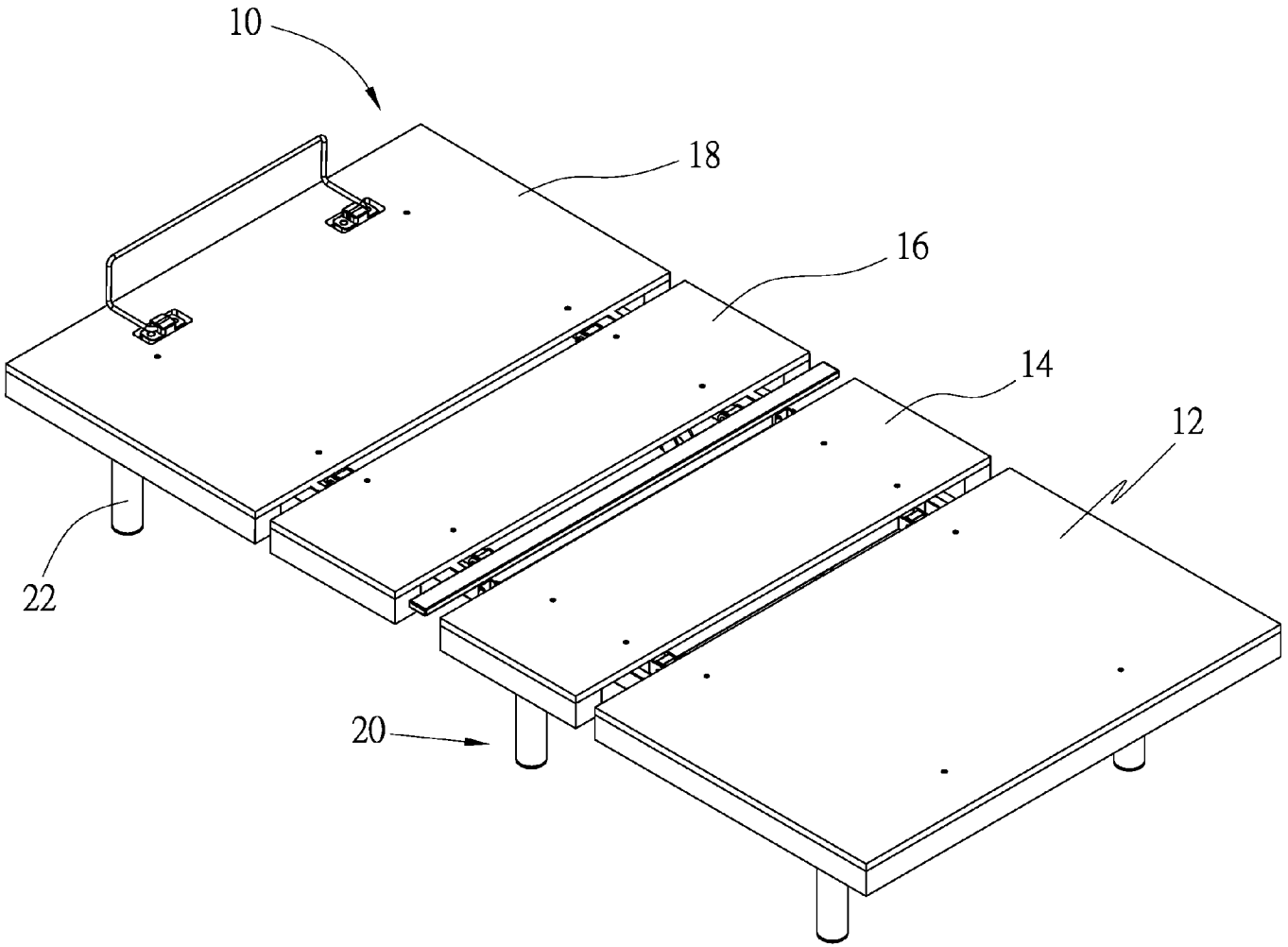
FIG. 1 is a perspective view of the top of a hospital bed according to the first embodiment of the present invention.
Figure 2:
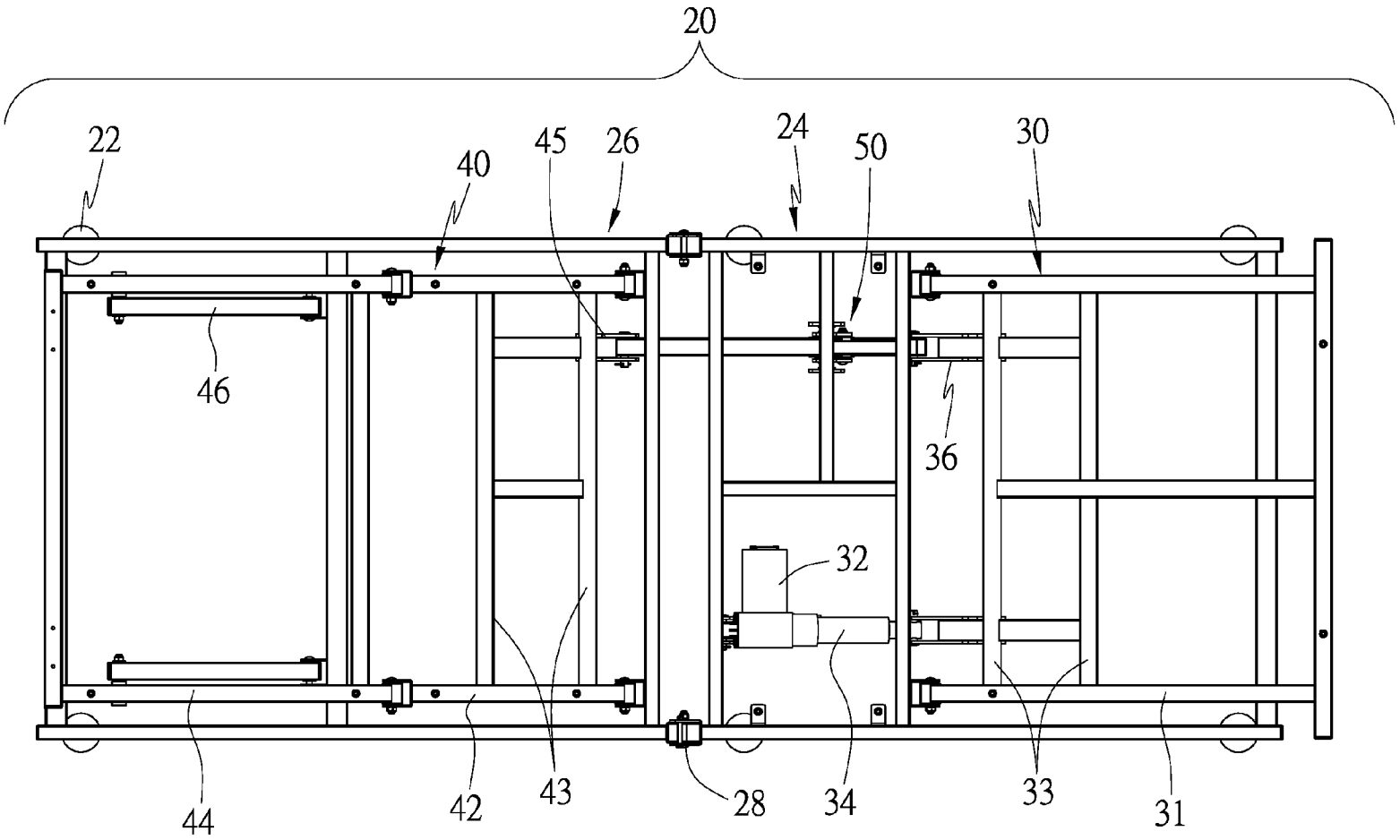
FIG. 2 is a top view of the hospital bed shown in FIG. 1.

Referring to FIGS. 1 and 2, a hospital bed 10 includes four boards 12, 14, 16 and 18, a frame 20, a backrest unit 30, a driving unit (not numbered), a leg support unit 40 and a linkage unit 50 according to a first embodiment of the present embodiment.

The frame 20 includes several posts 22, a first support unit 24 and a second support unit 26. The first support unit 24 is pivotally linked to the second support unit 26 by two hinges 28. The frame 20 preferably includes six posts 22. Four of the posts 22 are connected to the first support unit 24 while the other posts 22 are connected to the second support unit 26. Thus, the first support unit 24 and the second support unit 26 are supported on the posts 22, which are supported on a floor.

The backrest unit 30 includes two backrest rods 31, at least two crossbars 33 and two lugs 36. Both of the backrest rods 33 are pivotally connected to the first support unit 24. Each of the crossbars 33 includes two ends connected to the backrest rods 31 by welding for example. Thus, the backrest rods 31 are connected to each other by the crossbars 33. Both of the lugs 36 are connected to the crossbars 33 by welding for example.

The driving unit includes a motor 32 and a telescopic element 34. The telescopic element 34 can be a hydraulic cylinder, a pneumatic cylinder, or any other proper extensible element. An end of the motor 32 is connected to the first support unit 24. Another end of the motor 32 is connected to an end of the telescopic element 34. Another end of the telescopic element 34 is connected to an end of one of the lugs 36. Thus, rotation of the motor 32 can be converted to extension and withdrawal of the telescopic element 34, and the extension and withdrawal of the telescopic element 34 can be converted to pivoting of the backrest unit 30 relative to the frame 20 between a lifted position and a lowered position. In the lifted position, the backrest unit 30 lifts a patient's body. In the lowered position, the backrest unit 30 lowers the patient's body.

The leg support unit 40 includes two upper leg support rods 42, two lower leg support rods 44 and two rockers 46.

An end of each of the upper leg support rods 42 is pivotally connected to a portion of the second support unit 26, opposite to the backrest unit 30. An end of each of the lower leg support rods 44 is pivotally connected to another end of a corresponding one of the upper leg support rods 42. An end of each of the rockers 46 is pivotally connected to another end of a corresponding one of the lower leg support rods 44. Another end of each of the rockers 46 is pivotally connected to another portion of the second support unit 26. Thus, the leg support unit 40 is movable between a lifted position and a lowered position. In the lifted position, the leg support unit 40 is in a bent shape. In the lower position, the leg support unit 40 is in a rectilinear shape.

The leg support unit 40 further includes two crossbars 43 and at least one lug 45. The upper leg support rods 42 are connected to each other by the crossbars 43, with two ends of each of the crossbars 43 connected to the upper leg support rods 42 by welding for example. The lug 45 is connected to the crossbars 43 by welding for example.

Figure 3:
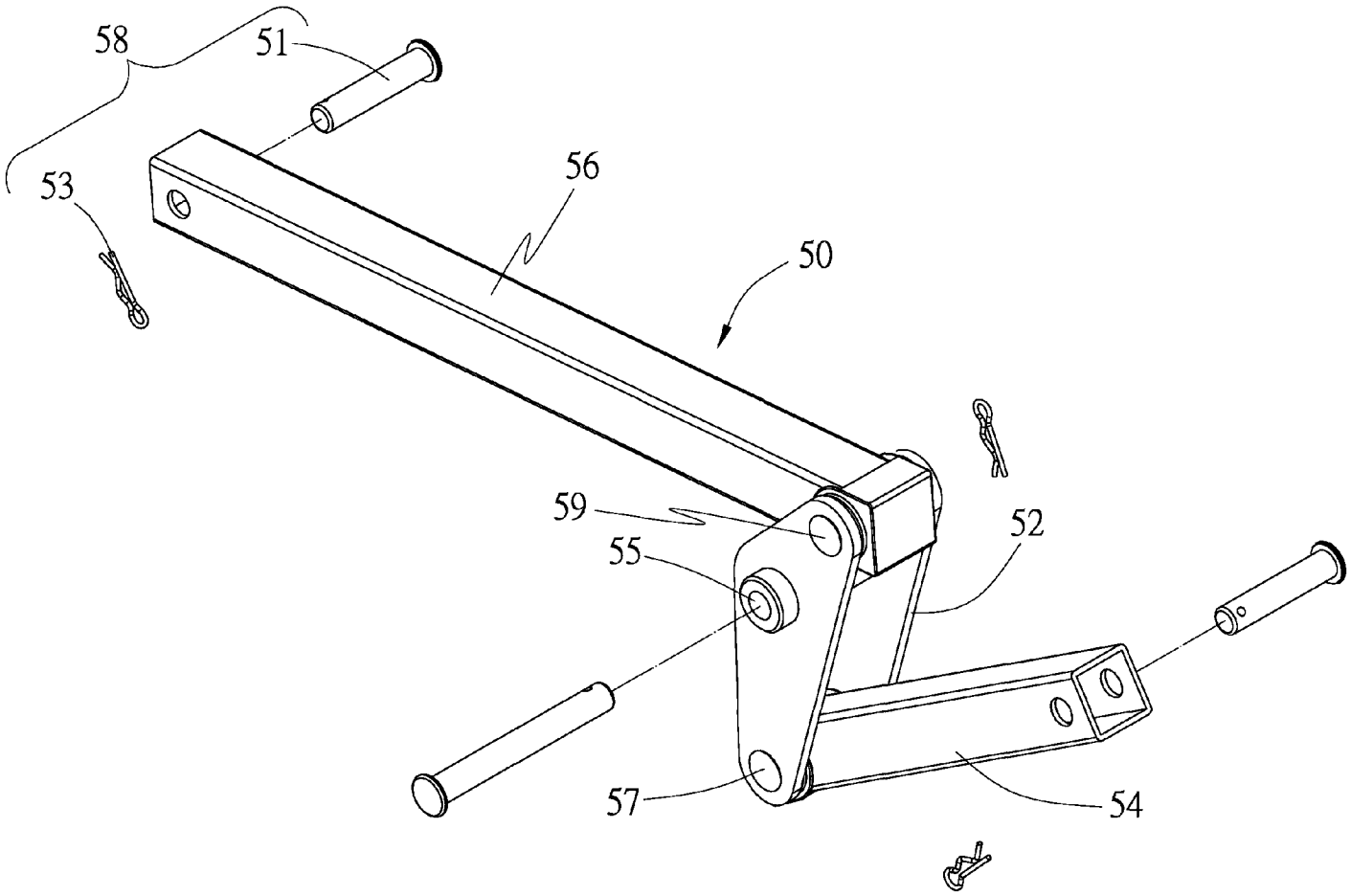
FIG. 3 is a perspective view of a linkage unit of the hospital bed shown in FIG. 1.

Referring to FIG. 3, the linkage unit 50 includes two levers 52, a first linking rod 54 and a second linking rod 56. Each of the levers 52 includes a bore 55, a first end 57 and a second end 59. The bore 55 is located between the first end 57 and the second end 59.

Figure 4:
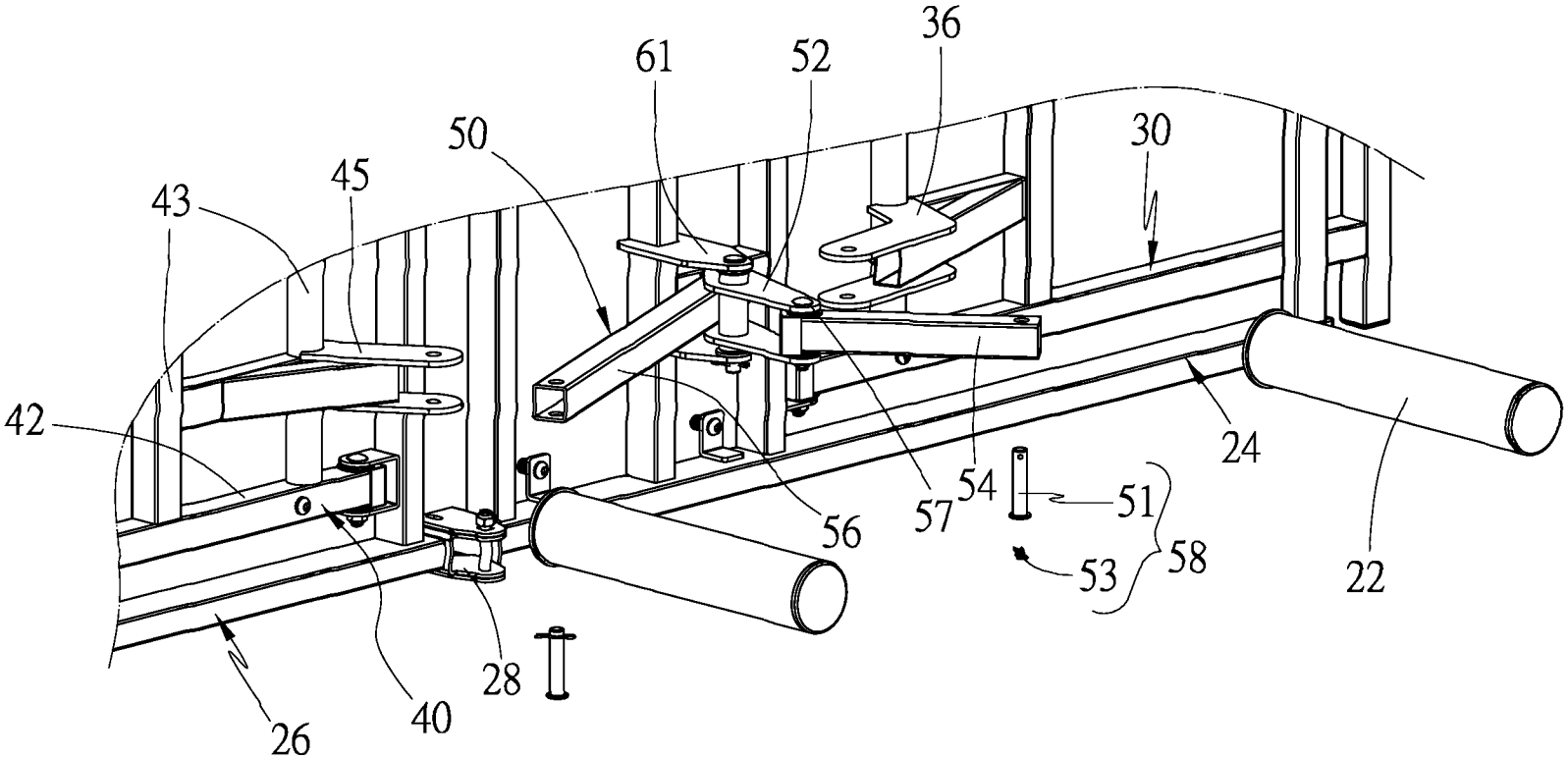
FIGS. 4 and 5 are two perspective view of the linkage unit shown in FIG. 3 connected to other parts on a lower side of the hospital bed shown in FIG. 1.
Figure 5:
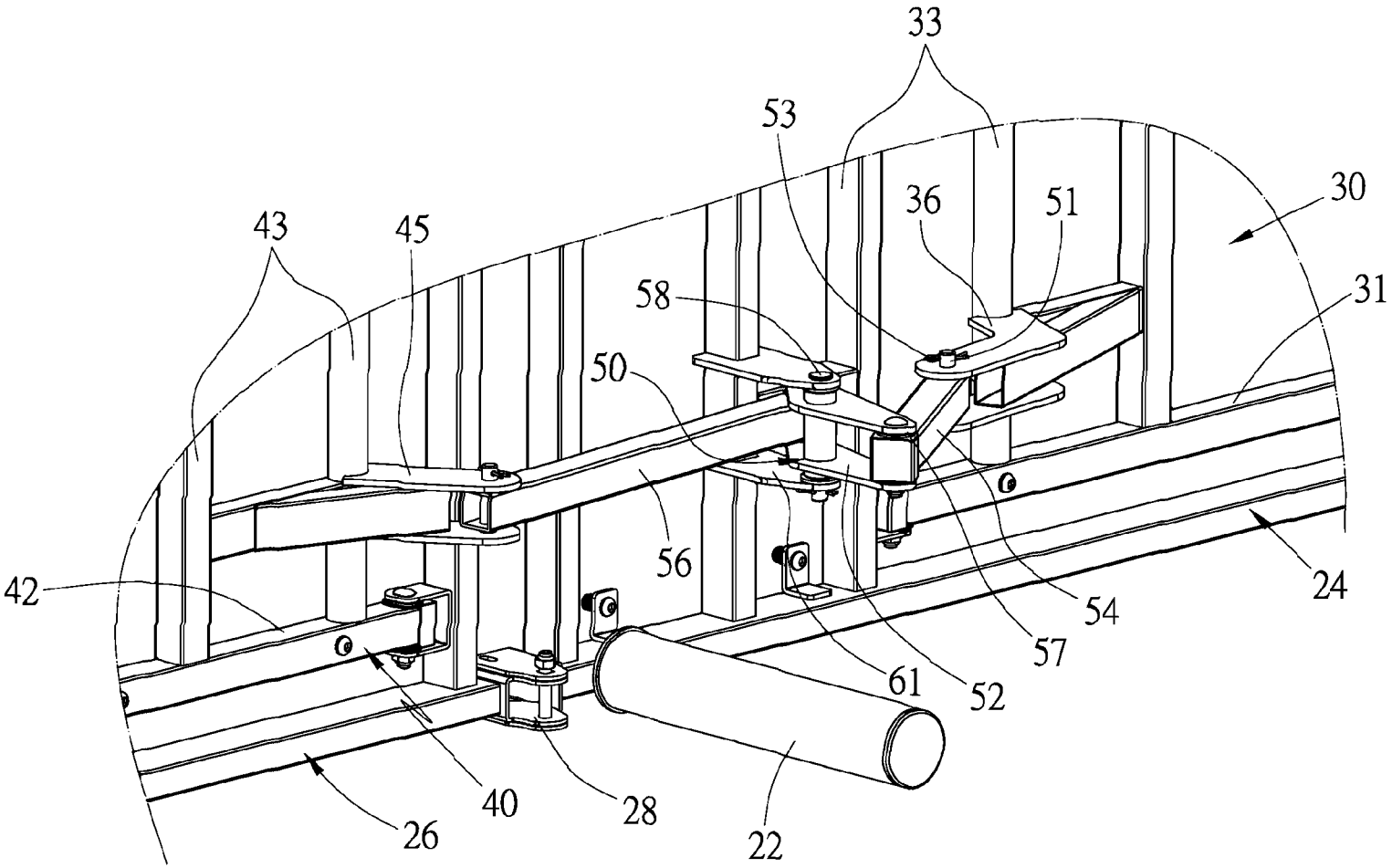

Referring FIGS. 4 and 5, a pivotal connection unit 58 is used to pivotally connect the levers 52 to two lugs 61 connected to the first support unit 24 of the frame 20 by welding for example. The pivotal connection unit 58 includes a pivot 51 and a pin 53. The pivot 51 includes an enlarged head at an end and an aperture near another end. The pivot 51 is inserted in the lugs 61 and the bores 55 of the levers 52 before the pin 53 is inserted in the aperture made in the pivot 51. The enlarged head of the pivot 51 and the pin 53 together keep the pivot 51 in position, thereby ensuring the pivotal connection of the levers 52 to the first support unit 24 of the frame 20.

The first end 57 of each of the levers 52 is pivotally connected to an end of the first linking rod 54. Another end of the first linking rod 54 is pivotally connected to an end of the other lug 36 by another pivotal connection unit 58.

The second end 59 of each of the levers 52 is pivotally connected to the second linking rod 56. Another end of the second linking rod 56 is pivotally connected to an end of the lug 45 by another pivotal connection unit 58.

As discussed above, the leg support unit 40 is connected to the backrest unit 30 by the linkage unit 50. Hence, the leg support unit 40 is movable together with the backrest unit 30. That is, both of the leg support unit 40 and the backrest unit 30 can be driven by the driving unit, which includes the motor 32 and the telescopic element 34.

Advantageously, the linkage unit 50 is collapsible to reduce the volume for the storage thereof. Such reduction is good for packing and transporting.

Each of the pivotal connection units 58 includes a pivot 51 and a pin 53 in the above-described embodiment. However, each of the pivotal connection units 58 can include a rivet or a combination of a threaded bolt with a nut in another embodiment.

Figure 6:
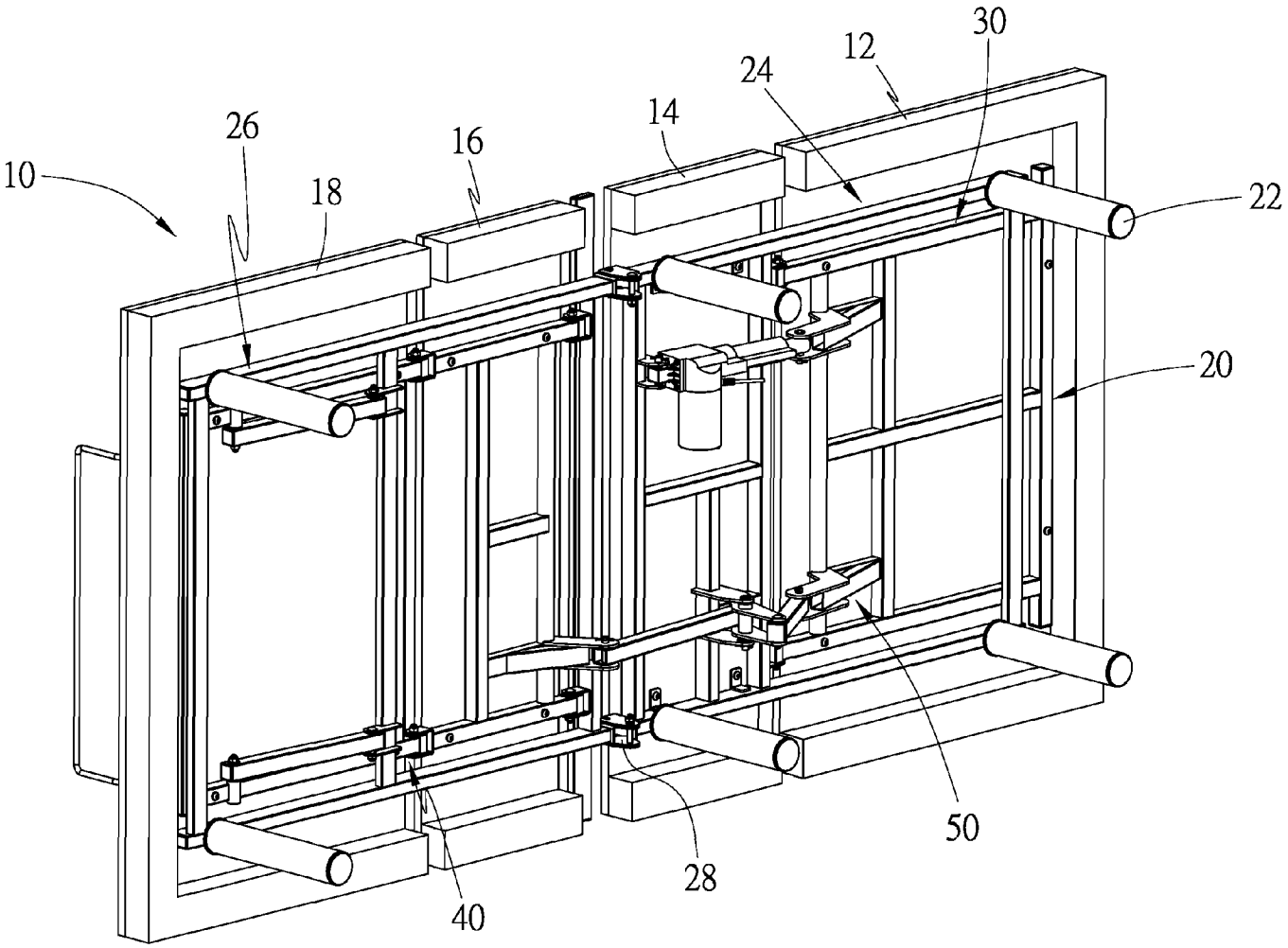
FIG. 6 is perspective view of the bottom of the hospital bed shown in FIG. 1.

Referring to FIGS. 1 and 6, the board 12 is connected to the backrest unit 30. The board 14 is connected to the first support unit 24, without interfering with the movement of the backrest unit 30. The board 16 is connected to the upper leg support rods 42. The board 18 is connected to the lower leg support rods 44.

The leg support unit 40 is in the lifted position when the backrest unit 30 is in the lifted position because the leg support unit 40 is connected to the backrest unit 30 via the linkage unit 50. The telescopic element 34 locates the backrest unit 30 at an angle relative to the first support unit 24 of the frame 20. Moreover, the second linking rod 56 locates the upper leg support rods 42 at another angle relative to the second support unit 26 of the frame 20. The lower leg support rods 44 and the rockers 46 together locate the lower leg support rods 44 at another angle relative to the second support unit 26 of the frame 20. The combination of each upper leg support rod 42 with the corresponding lower leg support rod 44 is in a bent shape in compliance with the patient's legs. Thus, the upper leg support unit 40 can properly support the patient's legs.

The leg support unit 40 is in the lowered position when the backrest unit 30 is in the lowered position because the leg support unit 40 is connected to the backrest unit 30 via the linkage unit 50. Now, the telescopic element 34 makes the backrest unit 30 flush with the first support unit 24 of the frame 20. The first linking rod 54 makes the levers 52 flush with the first support unit 24 of the frame 20. The second linking rod 56 makes the upper leg support rods 42 flush with the second support unit 26 of the frame 20. The upper leg support rods 42 and the rockers 46 together make the lower leg support rods 44 flush with the second support unit 26 of the frame 20. The combination of each upper leg support rod 42 with the corresponding lower leg support rod 44 is in a rectilinear shape.

Figure 7:
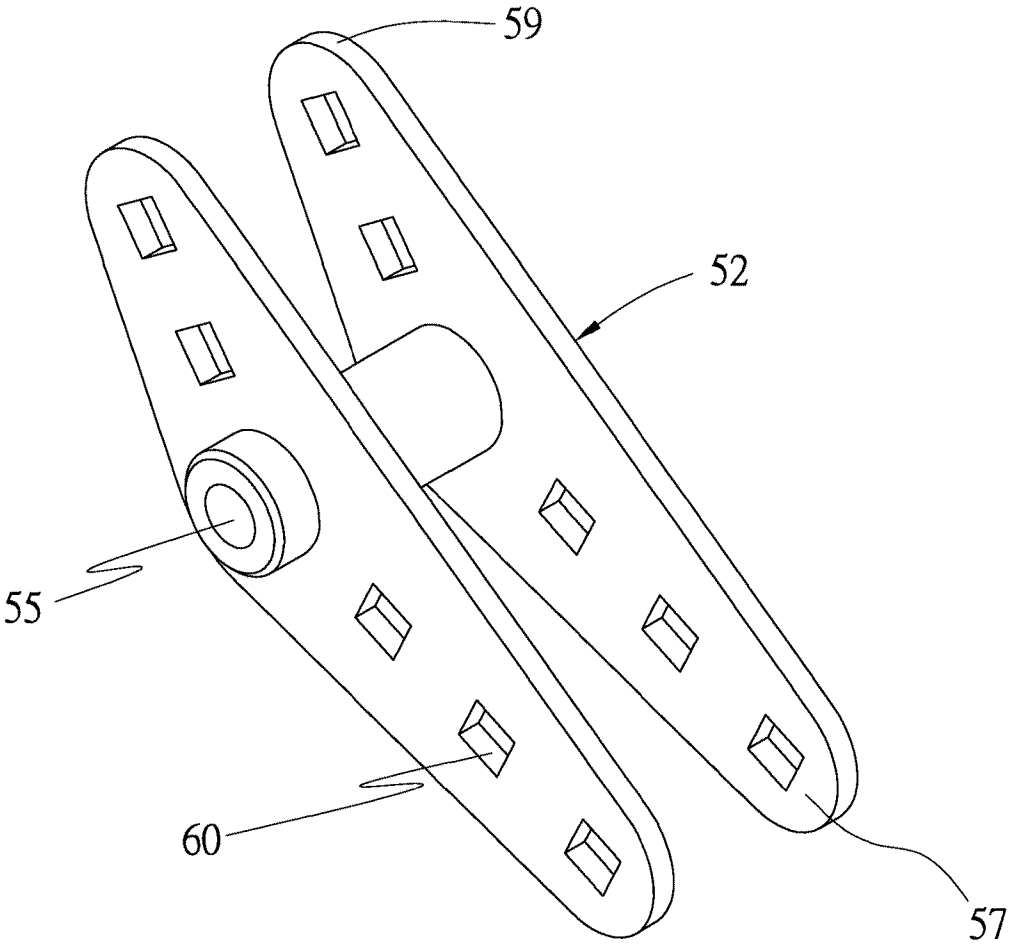
FIG. 7 is a perspective view of a lever of the hospital bed according to the second embodiment of the present invention.

Referring to FIG. 7, there are two levers 52 according to a second embodiment of the present invention. The second embodiment is identical to the first embodiment except that each of the levers 52 further includes a first group of adjusting apertures 60 and a second group of adjusting apertures 60. In each of the levers 52, the bore 55 is located between the first group of adjusting apertures 60 and the second group of adjusting apertures 60. By inserting a pin in the first linking rod 54 and one of the adjusting apertures 60 in the first group and another pin in the second linking rod 56 and one of the adjusting apertures 60 in the second group, the leg support unit 40 is located in a selected one of positions relative to the second support unit 26.

The present invention has been described via the detailed illustration of the embodiments. Those skilled in the art can derive variations from the embodiment without departing from the scope of the present invention. Therefore, the embodiments shall not limit the scope of the present invention defined in the claims.

The invention claimed is:

1. A hospital bed comprising:

a frame comprising posts supported on a floor;

a backrest unit pivotally connected to the frame;

a leg support unit comprising a portion pivotally connected to the frame and another portion pivotally connected to the backrest unit, wherein the leg support unit is located opposite to the backrest unit on the frame;

a driving unit comprising:

a motor connected to the frame and a telescopic element comprising an end operatively connected to the motor and another end pivotally connected to the backrest unit so that the motor moves the backrest unit between a lifted position and a lowered position relative to the frame via the telescopic element;

a linkage unit comprising:

at least one lever comprising a first end, a second end and a middle portion formed between the first and second ends, wherein the middle portion of the at least one lever is pivotally connected to the frame;

a first linking rod comprising an end pivotally connected to the first end of the at least one lever and another end pivotally connected to the backrest unit; and a second linking rod comprising an end pivotally connected to the second end of the at least one lever and another end pivotally connected to the leg support unit;

wherein in the lifted position, the backrest unit is located at an angle relative to the frame by the telescopic element, and the leg support unit is located at another angle relative to the frame via the linkage unit;

wherein in the lowered position, the backrest unit is flush with the frame, and the leg support unit is flush with the frame;

wherein the frame comprises a first support unit and a second support unit pivotally connected to the first support unit, wherein the backrest unit is pivotally connected to the first support unit, wherein the leg support unit is pivotally connected to the second support unit; and wherein the leg support unit comprises: at least one upper leg support rod comprising an end pivotally connected to the second support unit and a portion pivotally connected to the second linking rod; at least one lower leg support rod comprising an end pivotally connected to the second support unit and another end pivotally connected to the upper leg support rod; and at least one rocker comprising an end pivotally connected to the second support unit and another end pivotally connected to another end of the lower leg support rod.

2. The hospital bed according to claim 1, wherein the at least one lever further comprises a bore between the first and second ends, wherein the linkage unit further comprises a pivot inserted in the bore and the frame.

3. The hospital bed according to claim 2, wherein the at least one lever further comprises a first group of adjusting apertures on a side of the bore and a second group of adjusting apertures on another side of the bore, wherein one of the adjusting apertures in the first group receives a second pivot that is inserted in the first linking rod and one of the adjusting apertures in the second group receives a third pivot that is inserted in the second linking rod.

4. The hospital bed according to claim 2, wherein the linkage unit further comprises a pin inserted in the pivot to keep the pivot in the frame and the at least one lever.

5. The hospital bed according to claim 1, further comprising: a first board connected to the backrest unit; a second board connected to the first support unit, without interfering with the movement of the backrest unit; a third board connected to the upper leg support rod; and a fourth board connected to the lower leg support rod.

* * * * *